United States Patent [19]

Tucker

[11] 4,070,193

[45] Jan. 24, 1978

[54] CORROSION RESISTANT METAL SEALING FORMULATION

[75] Inventor: James Mackey Tucker, Decaturville, Tenn.

[73] Assignee: Kaddis Mfg. Co., Rochester, N.Y.

[21] Appl. No.: 614,753

[22] Filed: Sept. 19, 1975

[51] Int. Cl.[2] ..... C09D 5/08

[52] U.S. Cl. ..... 106/14; 148/6.21; 156/666; 252/79.2; 252/387

[58] Field of Search ..... 106/14; 148/6.2, 6.21; 252/79.2, 387; 156/2

[56] References Cited

U.S. PATENT DOCUMENTS

| | | | |
|---|---|---|---|
| 2,824,031 | 2/1958 | Stareck | 148/6.21 |
| 2,904,414 | 9/1959 | Ostrander et al. | 148/6.21 |
| 3,301,719 | 1/1967 | Groshart et al. | 148/6.21 |
| 3,351,555 | 11/1967 | Byers et al. | 252/79.2 |
| 3,362,911 | 1/1968 | Byers et al. | 252/79.2 |

*Primary Examiner*—Lorenzo B. Hayes

*Attorney, Agent, or Firm*—Jones, Thomas & Askew

[57] ABSTRACT

A bright finish on a copper or copper alloy metal piece is sealed by dipping the piece in an aqueous solution of sodium bichromate, chromic acid and sulfuric acid followed by rinsing in cold and then hot water. The sealed piece is quite resistant to corrosion.

1 Claim, No Drawings

CORROSION RESISTANT METAL SEALING FORMULATION

This invention relates to an aqueous sealing solution and a process for sealing copper and its alloys against corrosion following dipping of the copper or its alloys in a conventional brightening solution. More particularly the present invention relates to a solution and a process for using the solution whereby the bright finish on metal pieces is sealed against corrosion for a significant period of time. The term "copper," as used in this specification and claims hereafter, is meant to include any copper or alloy of copper such as brass or bronze.

It is conventional practice to dip copper metal pieces in a brightening solution which removes any residue present such as oil, wax and grease and any corrosion or tarnish present and improves the finish of the metal piece by brightening the finish. Such solutions are normally acidic in nature and their use and composition are well known in the industry. A typical brightening solution is sold by Ashland Chemical Company as "Super B." An excellent bright dip solution can be prepared by mixing equal parts of nitric acid and phosphoric acid and diluting the mixture with water. Following brightening, such metal parts are quite attractive because of the finish on the metal. However, after exposure to corrosive affects such finishes deteriorate and the metal parts as a whole corrode. Such a result is quite undesirable. Proposed solutions for coating the parts have been reported in the U.S. patent literature for many types of metals including aluminum, stainless steel, ferriferous, magnesium, magnesium alloys, zinc, cadmium, copper and copper alloys as follows:

George Duepermell, et al. (U.S. Pat. No. 2,194,498)
Edward F. Fischer (U.S. Pat. No. 2,613,165)
Andrew J. Hamilton (U.S. Pat. No. 3,635,826)
Richard O. Hull (2,154,451)
Eric Shelton-Jones (U.S. Pat. No. 2,650,156)
John C. Kosmos (U.S. Pat. No. 2,760,890)

It is an object of the present invention to provide an aqueous solution and a process for sealing the surface of copper metal pieces against corrosion for significant lengths of time. It is an additional object of the present invention to provide a solution which may be used as a dip for sealing the surface of copper metal pieces in an easily performed process. Other objects features and advantages of the present invention will become apparent from reviewing the following description. According to the present invention it is preferred that the copper metal pieces be first thoroughly cleaned to remove all foreign matter from the surfaces thereof. Following cleaning the metal pieces are dipped in a standard acidic brightening solution, such as "Super B" from Ashland Chemical Company, to remove surface metal oxides and other elements which dull the surface of the metal part and otherwise tarnish or discolor the metal surface. After bright dipping the metal piece it should be thoroughly rinsed in cold water (temperature of 60°–90° F) and prepared for sealing.

In carrying out the present invention it has been found that superior results are achieved by dipping the brightened article in an aqueous solution of sodium bichromate, chromic acid and sulfuric acid. The amount of sodium bichromate present may vary between about 1 and 3 pounds; the amount of chromic acid may vary between about ¼ ounce and 1 ounce; and the amount of sulfuric acid may vary between about 1 milliliter and 25 milliliters, for each gallon of water in the mixture.

In one specific embodiment of the present invention a solution is prepared by mixing together about 1½ pounds of sodium bichromate, about ½ ounce of chromic acid, and about 2 milliliters of sulfuric acid for each gallon of water in the mixture. The resulting mixture is somewhat concentrated for actual usage and therefore prior to actual usage an additional gallon of water is added to the mixture to prepare the final formulation. It should be understood that these figures are not absolute and that each may be varied, as is apparent to one of ordinary skill in the art, while still achieving the same excellent results of the present invention. It should be apparent that the amount of water present changes the concentration of the present formulation and that with decreasing concentration the length of time required for effective sealing will increase.

In the operation of the present process, the previously cleaned and brightened copper articles are dipped in the present aqueous solution for a period of time of from thirty seconds to five minutes. Longer periods of immersion in excess of two minutes may be utilized without harmful results but such longer periods appear to serve no useful purpose.

After dipping in the present solution, it is critical that the article be first rinsed in cold water at a temperature of from 60°–90° F for about one minute and then rinsed in hot water for about 1 minute. It has been found that the temperature of the hot water should range between 140° and 175° F. It should be understood that these two rinse steps must be accomplished by dipping the article first in cold water and then hot water.

Copper metal articles treated according to the present invention have been subjected to salt spray tests for as long as 100 hours without corrosion. A specific example is as follows:

EXAMPLE

Six brass metal parts are first cleaned and then dipped in a standard brightening solution and then dipped for 1 minute in an aqueous solution of the following:

1½ pounds sodium bichromate
½ oz. chromic acid
2 ml. sulfuric acid
2 gallons water The articles are then dipped for 1 minute in a cold water rinse at tap water temperature. The articles are then dipped for 1 minute in a hot water rinse at a temperature of 160° F. The articles are then dried.

The articles are then suspended in a salt spray chamber by means of nylon cord. The articles are subjected to salt spray exposure in this chamber according to ASTM-B-117-73. The temperature and salt exposure conditions are maintained at 95° F ± 3° with a 5% (neutral Ph) salt spray solution. These conditions are maintained for a period of 100 hours. The articles are removed from the chamber at the completion of 100 hours exposure, and rinsed with warm tap water at a temperature of 90° F. None of the six brass metal articles had any visible evidence of corrosive attack.

It will be understood that the foregoing relates only to preferred embodiments of the invention, and that numerous alterations or modifications may be made therein without departing from the spirit and scope of the invention as defined in the following claims.

I claim:

1. Aqueous solution for sealing a bright metal finish on copper and copper alloy metal articles consisting essentially of a mixture of about 1 to 3 pounds of sodium bichromate, about ¼ to 1 ounce of chromic acid, about 1 to 25 milliliters of sulfuric acid for each 2 gallons of water.

* * * * *